United States Patent [19]

Klein

[11] Patent Number: 4,566,725

[45] Date of Patent: Jan. 28, 1986

[54] DEADLOCK MECHANISM

[75] Inventor: David Klein, Montreal, Canada

[73] Assignee: Almet Hardware Limited, Canada

[21] Appl. No.: 579,193

[22] Filed: Feb. 10, 1984

[30] Foreign Application Priority Data

Jan. 30, 1984 [CA] Canada ..... 446296

[51] Int. Cl.[4] ..... E05C 5/02

[52] U.S. Cl. ..... 292/191

[58] Field of Search ..... 70/131, 380; 292/191, 292/192, 153, 49, 96, 27, 29, 34, 146, 153, 198

[56] References Cited

U.S. PATENT DOCUMENTS

| | | | |
|---|---|---|---|
| 539,653 | 5/1895 | Stevens . | |
| 809,209 | 1/1906 | O'Connor | 292/192 |
| 881,614 | 3/1908 | Pfleghar, Jr. . | |
| 1,192,449 | 7/1916 | Ottinger | 292/191 |
| 1,223,110 | 4/1917 | Rein et al. | 292/192 X |
| 2,668,073 | 2/1954 | Collar et al. | 292/192 |
| 3,175,376 | 3/1965 | Cantwell . | |
| 3,257,135 | 6/1966 | Russell et al. . | |
| 3,582,119 | 6/1971 | Woodworth . | |
| 3,921,334 | 11/1975 | Black, Sr. . | |
| 4,015,456 | 4/1977 | Moberg . | |

FOREIGN PATENT DOCUMENTS

| | | |
|---|---|---|
| 238467 | 3/1924 | Canada . |
| 721027 | 11/1965 | Canada . |
| 791392 | 8/1968 | Canada . |
| 1068745 | 12/1979 | Canada . |

OTHER PUBLICATIONS

Deadlock 2331, SL 5, Adams Rite Manufacturing Co., of California 91749, United States, 1967–1976.

Official Gazette, Jun. 1, 1971, Lock with Multiple Bolt Action, John A. Woodworth of California, 1969, U.S. Pat. No. 3,582,119.

*Primary Examiner*—Richard E. Moore

*Attorney, Agent, or Firm*—Bacon & Thomas

[57] ABSTRACT

A deadlock mechanism comprises a casing having a facing plate provided with a bolt aperture and a bolt movable through the aperture between an unlocking position and a locking position. This bolt is connected to a reciprocable plunger, the bolt being made up of a pair of levers each having a locking ear at its forward end and a camming lug at its rearward end, the rearward ends of the levers being pivotally mounted at the end of the plunger so as to pivot in opposite directions when the bolt moves out of the casing into locking position. Movement of the bolt and pivoting of the levers as they move in and out of the casing is obtained by the coaction of camming edges on the levers and cam followers within the casing.

6 Claims, 7 Drawing Figures

DEADLOCK MECHANISM

The present invention relates to a deadlock mechanism, that is to a lock where the bolt is moved longitudinally axially by a key between locking and unlocking positions. It also relates to a closure assembly having a closure member, such as a door, movable with respect to a closure frame, this closure assembly making use of the aforesaid deadlock mechanism.

The deadlock mechanism with which the invention is concerned is of the type in which the locking bolt has a pair of levers having locking ears at their forward ends. The levers are pivotable to project the ears laterally, as the bolt reaches locking position so as to lie behind the strike plate of the closure frame. The purpose is to prevent any attempt, by burglars, at prying the striking plate away from the facing plate of the deadlock mechanism to thereby free the bolt of the strike plate and thus allow opening of the door. This jimmying operation may no longer be done with this type of bolt construction since, in locking position, the locking ears stand behind the strike plate whereby the bolt may not be freed from the strike plate.

The following patents are known to relate, some only generally, to the use of this type of bolt construction: U.S. Pat. No. 539,653 of May 21, 1895; U.S. Pat. No. 881,614 of Mar. 10, 1908; U.S. Pat. No. 2,668,073 of Feb. 2, 1954; U.S. Pat. No. 3,175,376 of Mar. 30, 1965; U.S. Pat. No. 3,257,135 of June 21, 1966; U.S. Pat. No. 3,582,119 of June 1, 1971; U.S. Pat. No. 3,921,334 of Nov. 25, 1975; U.S. Pat. No. 4,015,456 of Apr. 5, 1977; U.S. Pat. No. 4,063,434 of Dec. 20, 1977 and Canadian Pat. No. 238,467 of Mar. 11, 1924; No. 721,027 of Nov. 9, 1965; No. 791,392 of Aug. 6, 1968; No. 1,068,745 of Dec. 25, 1979.

It is believed that the best representative of this type of lock is the one illustrated in U.S. Pat. No. 3,582,119. In the deadlock mechanism disclosed in this patent, as in most of the patents pertaining to the above-defined lever-bolt mechanism, the pivoting levers or dogs are spring loaded into locking engagement behind the strike plate and this spring action may give rise to considerable difficulties. Indeed, with time, the spring or springs loses its efficiency and it has occurred that the locking mechanism has jammed in locking position. It will be appreciated that this situation is precisely that faced by a burglar with this type of lever-bolt deadlock when locked; because of the locking ears or dogs being located behind the strike plate, it is not sufficient to bend the strike plate or the door frame edge wall, usually made of aluminum, away from the facing plate of the lock casing to free the bolt. The only solution then is to cut around the bolt, through the strike plate and corresponding door stile, to remove the bolt. It will therefore be appreciated that this will destroy the door frame and, possibly, the deadlock mechanism itself.

Another inconvenience is that the levers are spring actuated to locking position so that, again with time and as the spring or springs stiffen, or wear out, a greater force has to be developed to withdraw the bolt from the strike plate in view of the antagonistic action of the spring or springs.

Another important drawback with locks using spring-actuated levers or dogs is that, where the bolt apertures in the facing edges of the door closure and door frame do not quite properly register, the spring action has been known to start untimely resulting in either jamming of the door or preventing completion of the locking operation.

It is therefore a main object of the invention to provide a deadlock mechanism which is entirely free of any spring and relies solely on the use of a simple cam and cam follower mechanism which gives a positive action at all times, action that is devoid of any difficulties arising from any parts of the locking mechanism becoming worn out, after a predetermined period of use.

More specifically, according to the invention, the levers of the bolt are formed with camming edges which cooperate constantly with cam followers in the lock casing both during extraction of the bolt out of the casing for unlocking or withdrawal of the bolt within the casing for unlocking.

A description of preferred embodiments of the invention now follows with reference to the appended drawings wherein.

Figure 1:
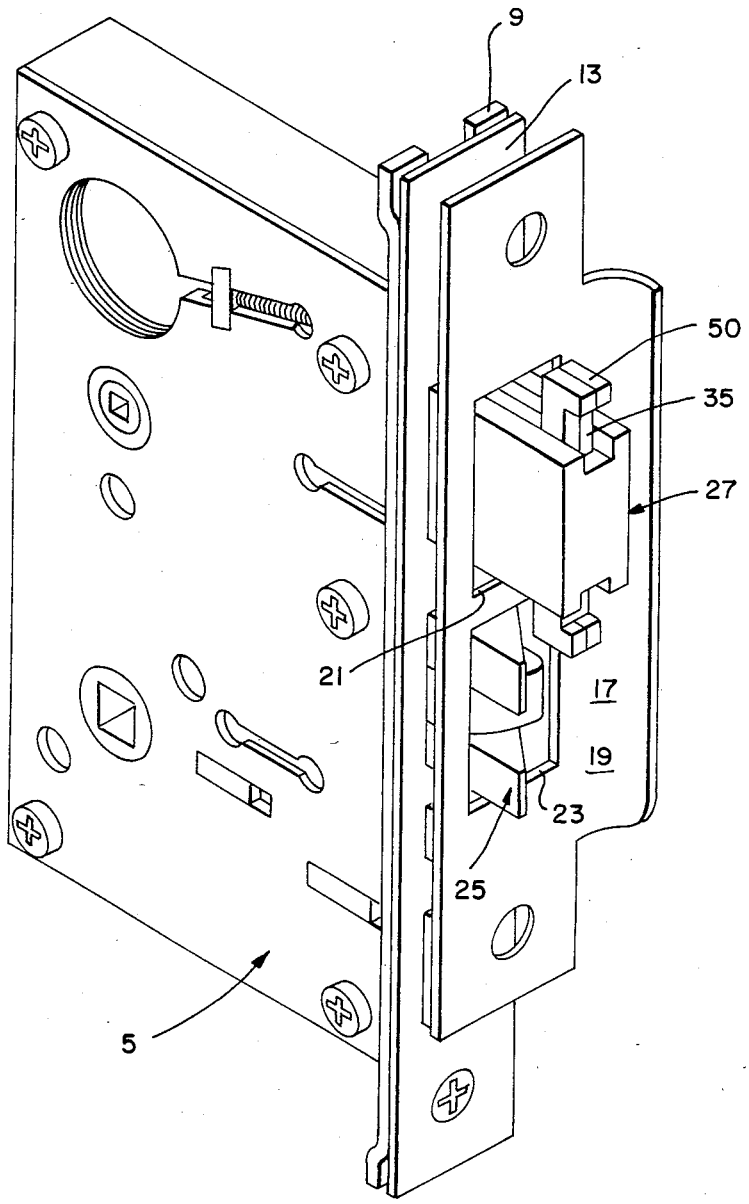
FIG. 1 is a perspective view of a deadlock mechanism incorporating the improvement of the invention.
Figure 3:
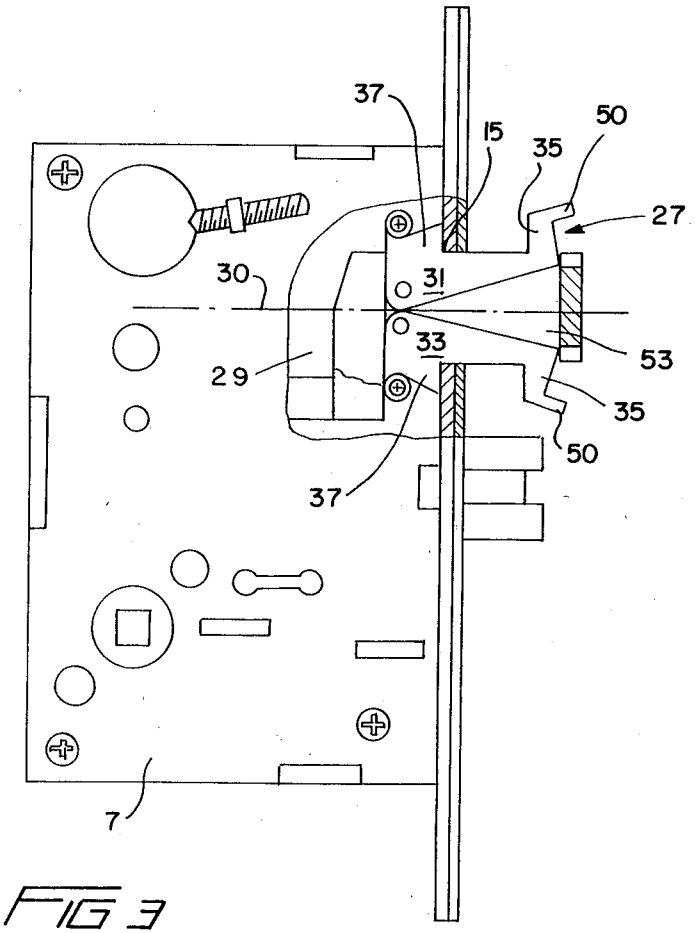
FIG. 3 is a side elevation of the deadlock mechanism of FIG. 1, the bolt being shown in locking position.
Figure 2:
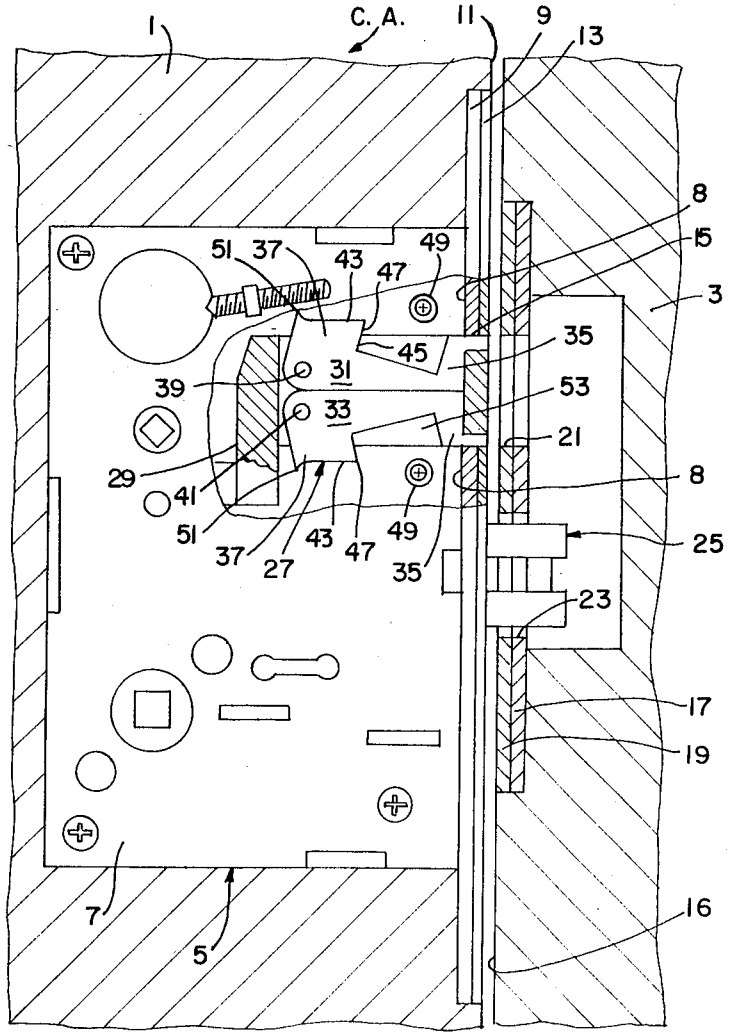
FIG. 2 is a side elevation view, partly broken away to show pertinent inner structure, of the deadlock mechanisn of FIG. 1, shown in retracted condition of the bolt and mounted on a closure assembly.

Referring now to the embodiment of FIGS. 1, 2 and 3, more particularly FIG. 2, there is shown a closure assembly C.A. having a closure member 1, such as a door, pivotally supported on a closure frame 3 for movement relative to the said frame 3. The closure member 1 contains a deadlock mechanism 5, made according to the present invention. This deadlock mechanism 5 serves of course to lock the closure member 1 to the closure frame 3. In FIG. 2, the door 1 is closed in the frame 3 and the deadlock mechanism 5 is in unlocked position while in FIG. 3, it is in locked position. The deadlock mechanism is mounted inside the closure member 1 and comprises a casing 7 having a facing plate 9 screwed onto an edge wall 11 of the closure member 1. Usually, this facing plate 9 is provided with a covering decorative plate 13 screwed along with the facing plate 9. Both plates are provided with registering bolt apertures 15 for the passage of the lock bolt and, practically, defining a single bolt aperture 15.

Similarly, the edge wall 16 of the closure frame 3 has a pair of overlapping striker plates 17 and 19 screwed thereto and provided with a pair of like size registering apertures defining a bolt aperture 21 facing and registering with the bolt aperture 15 when the door 1 is closed and the edges 11 and 16 face one another. Plates 17 and 19 may further be provided with an additional aperture 23 for the passage of a standard knob or handle operated bolt 25.

A lock operating means is provided within the casing 5 to move a bolt 27, made according to the invention and to be further described hereinafter, along a longitudinal axis of the said bolt 27 and through the bolt apertures 15 and 21 between the unlocking position of FIG. 2 to the locking position of FIGS. 1 and 3. The lock operating means which is of standard construction includes a plunger 29 which is reciprocable along the longitudinal axis 30 (FIG. 3) of the bolt 27 to move the latter between the aforesaid unlocking and locking positions.

The bolt 27 itself comprises a pair of levers 31, 33, each having a forward end provided with a locking ear 35 extending laterally from the axis 30 (FIG. 3) of the bolt 27 and a rearward end provided with a camming lug 37 laterally extending away from the axis 30, the ear 35 and the lug 37 of the lever 31 lying on one side of the axis 30 while the ear 35 and lug 37 of the other lever 33 lies on the other side thereof.

As clearly shown in FIGS. 2 and 3, means mount the rearward end of each lever 31, 33, on the plunger 29 for pivotal movement about an axis transverse to the plunger 29. In the embodiment of FIGS. 2 and 3, the pivot means comprise a pair of pins 39, 41, mounted across the levers 31, 33 and on the end of the plunger 29, each pin being located on one side of the axis 30 and the levers 31, 33, extending side by side, as shown.

The camming lug 37 of each lever defines, in the unlocking position of the bolt 27 as shown in FIG. 2, a longitudinal camming edge 43 which is essentially parallel to the axis 30 and a rearwardly inclined camming edge 45, the edges 43 and 45 meeting one another at a rounded camming point 47.

Cam follower means, further described hereinbelow, are provided in the casing 5 and cooperate with the caming point 47 for pivoting the levers 31, 33, when the bolt 27 is extended out of the casing 5 in such a manner that the locking ears 35 move away from the axis 30 into the locking position of the bolt 27 which is the situation shown in FIG. 3. This cam follower means further cooperate with the longitudinal camming edges 43 to pivot the levers 31, 33, in reverse direction when the bolt 27 is retracted into the unlocking position which is that of FIG. 2.

The cam follower means comprise an inner wall portion 8 of the facing plate 9 which circumscribes the bolt aperture 15 and against which portion the camming points 47 butt as the bolt 27 is extended outwardly of the casing 5 by the plunger 29. As a study of FIGS. 2 and 3 reveals, as soon as the rounded camming points 47 touch the aforesaid part of the facing plate 9, the levers 31, 33, start pivoting and thus cause the locking ears 35 to move in a direction away from the axis 30 which is the position shown in FIG. 3. Simultaneously, the camming edges 43 move from the horizontal position of FIG. 2 where they are parallel to the axis 30, as aforesaid, to an upwardly inclined position clearly shown in FIG. 3.

The cam follower means further comprise rollers 49 mounted in the casing 5, one being provided on each side of the axis 30, above the levers 31, 33, and behind the inner surface of the facing plate 9. As best shown in FIG. 3, these rollers 49 are located so as to press on the inclined camming edges 43 to pivot the levers 31, 33, and bring the camming edges 43 back into the horizontal position of FIG. 2 when the bolt 27 is retracted into the casing 5 and to the unlocking position.

The ears 35 are preferably provided with outwardly projecting lugs 50 which lie immediately opposite the bolt aperture 15 of the facing plate 9, 13, in unlocked position of the bolt 27, as shown in FIG. 2. These lugs 50 have outward faces of a preferred length such that as soon as they move out of the bolt aperture 15, the rollers 49 start to bear on the camming edges 43 to prevent untimely opening of the levers 31, 33.

Preferably, the longitudinal camming edges 43 terminate, rearwardly, into curving tips 51 intended to assist in the pivotal movement of the levers 31, 33.

Preferably also, the plunger 29 may have a forward portion provided with a transverse slot 53 in which the levers 31, 33, are mounted in retracted position of the bolt 27 which is the situation of FIG. 2. When the bolt 27 is in locking position, at least the ears 35 project out of the slot 53, which is the position shown in FIG. 3.

Figure 4:
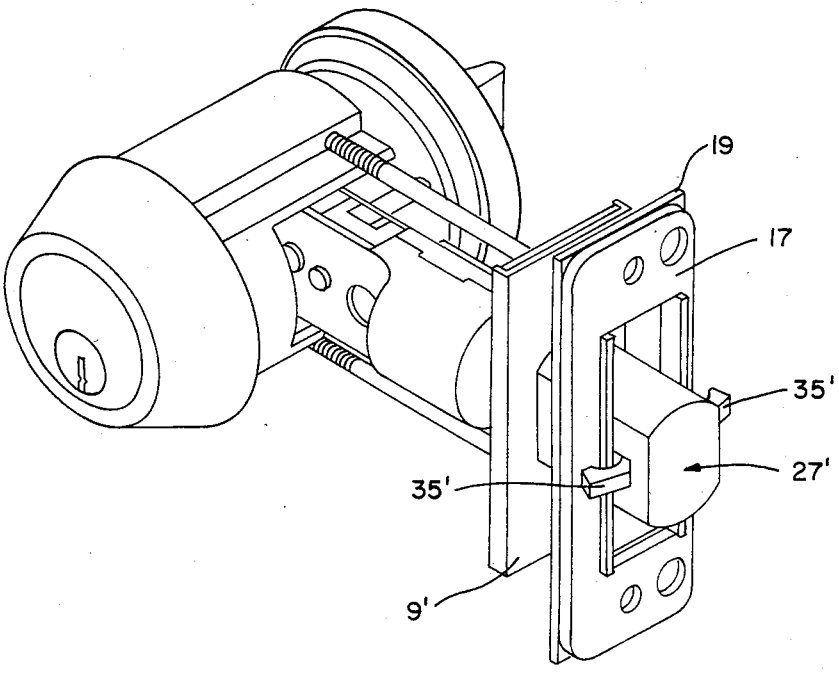
FIG. 4 is a perspective view of a deadlock assembly of the tubular type, including the features of the present invention.
Figure 5:
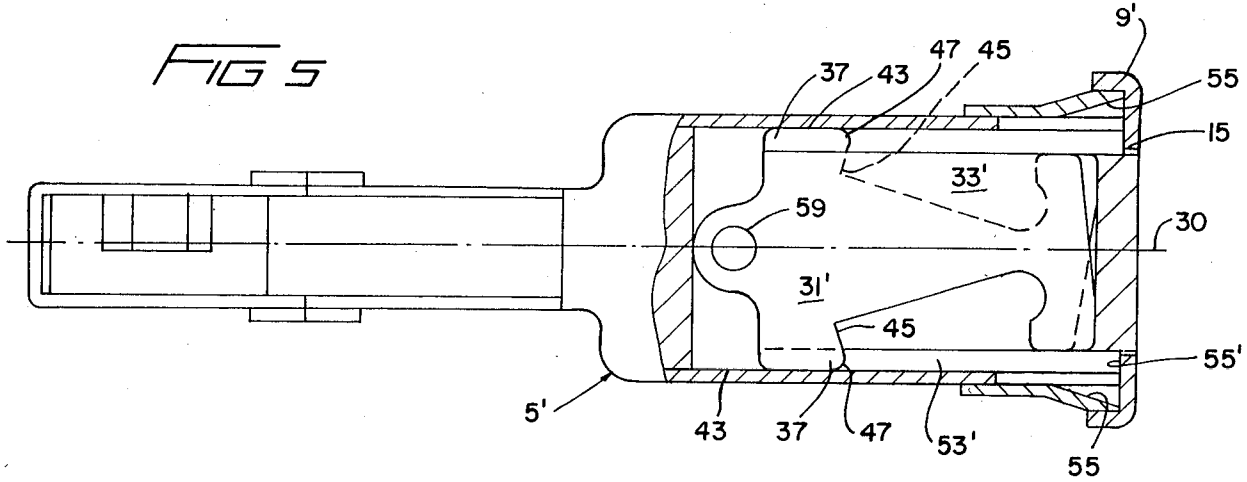
FIGS. 5 and 6 are side elevation views, partly broken away, of the deadlock mechanism of FIG. 4 in unlocked and locked positions, respectively.
Figure 6:
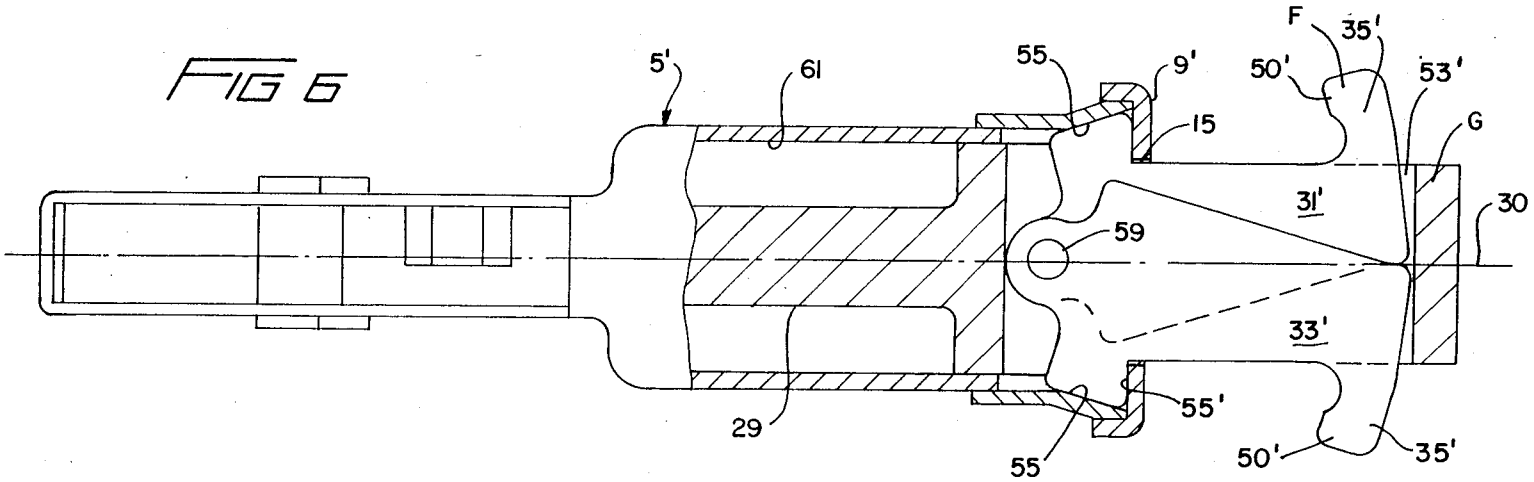

The particular embodiment shown in FIGS. 4, 5 and 6 illustrates clearly that the deadlock mechanism according to the invention is particularly well suited for the tubular type of lock. As best shown in FIGS. 5 and 6, the bolt levers 31', 33', are essentially of the same shape as the corresponding levers of the first embodiment at least with respect to the camming lugs 37 which are seen to comprise the longitudinal camming edge 43, the radially inclined camming edge 45 and the rounded camming point 47. Outward pivoting of the levers 31', 33', is therefore obtained in the same manner, that is the two levers pivot outwardly as the rounded camming point 47 reaches an inner surface 55' of the facing plate 9'. At that time, as in the embodiment of FIGS. 1, 2 and 3, further outward movement of the bolt 27' causes moving of the camming point 47 and consequent outward pivoting of the levers and placing of the locking ears 35' in locking position.

In this case however the follower rollers 49 are replaced by guiding surfaces 55, on opposite sides of axis 30 inside casing 5', extending away from the inner face 55', of the facing plate 9', circumscribing the bolt aperture 15. These guiding surfaces 55, as shown, are inclined rearwardly and downwardly toward the axis 30 and are located so as to be contacted by the longitudinal camming edges 43 as the bolt 27' extends out of the casing 5', the situation being clearly shown in FIG. 6.

Thus, as the bolt 27' is withdrawn within the casing 5', these inclined camming surfaces 55 force the levers 31', 33', to move in reverse direction to allow them through the bolt aperture 15 and inside the casing 5'.

In this particular instance, the means mounting the levers 31', 33', comprise a single pin 59 mounted across both levers and at the end of the plunger 29, this pin having a pivot axis which intersects the horizontal axis 30 while the levers 31', 33', overlap one another in retracted position of the bolt 27' and partly so in extracted position.

As in the embodiments of FIGS. 1, 2 and 3, the plunger 29 has a forward position provided with a transverse slot 53' and the levers 31', 33', are mounted in this slot while the locking ears 35' project out of the slot 53' in locking position of the bolt 27'.

In this particular embodiment, the ears 35' may be bent slightly rearwardly to define lugs 50' intended to add strength to the ears 35' and allow them to come closer to the inner face of the striker plate 17, in locking position of the bolt 27'.

Figure 7:
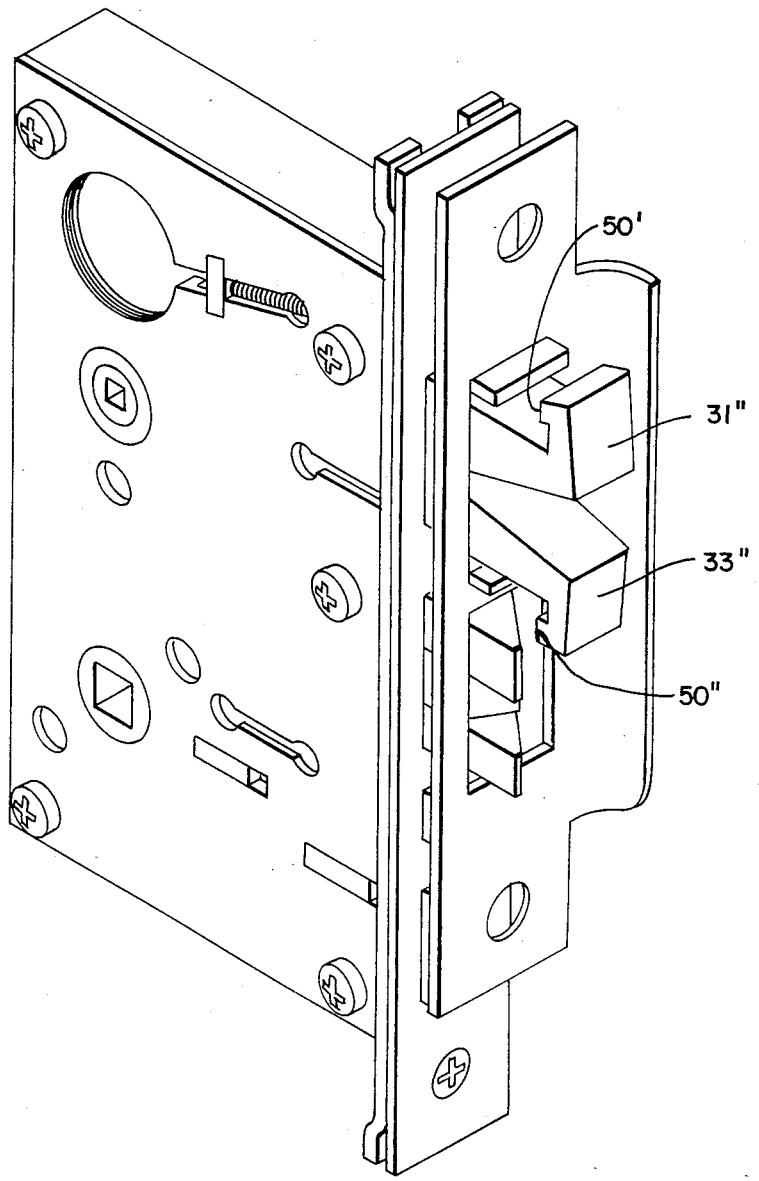
FIG. 7 is a perspective view of a further embodiment of the invention.

The embodiment shown in FIG. 7 relates to a deadlock mechanism also according to the invention but wherein the bolt itself is entirely devoid of the plunger extension of the previous embodiment, the levers 31'', 33'' lying side by side as in the embodiment of FIGS. 1, 2 and 3 but having interned lugs 50'' as in the embodiments of FIGS. 4, 5 and 6. The operation of this deadlock mechanism is of course the same as that of the previous embodiment.

I claim:

1. A deadlock assembly for mounting in a closure member for locking the closure member to an associated frame, the assembly comprising:

(a) a casing including a facing plate provided with a bolt aperture, and having an inner wall portion circumscribing the aperture;

(b) a bolt having a longitudinal axis and mounted within the casing for reciprocal movement along the longitudinal axis between an unlocked rearward position wherein the bolt is disposed within the casing and a locked forward position wherein the bolt extends out of the casing through the bolt aperture;

(c) a pair of levers, the levers being disposed on opposite sides of the longitudinal axis, with each lever including a forward end provided with a locking ear and a rearward end provided with a camming lug spaced from the locking ear, the locking ear and camming lug extending laterally away from the longitudinal axis;

(d) means for mounting the rearward end of each lever on the bolt for pivotal movement about an axis extending transversely of the longitudinal axis;

(e) each camming lug being configured to define, when the bolt is moved to the unlocked rearward position, a longitudinal camming edge disposed substantially parallel to the longitudinal axis and a rearward inclined radial camming edge, the longitudinal and radial camming edges converging to form a cammng point for engaging the inner wall portion; and (f) a cam follower means disposed within the casing on either side of the levers and spaced from the inner wall portion, each cam follower means being positioned to engage the longitudinal camming edge of a corresponding camming lug for maintaining the longitudinal camming edge parallel to the longitudinal axis until the camming point engages the inner wall portion, thereby causing the locking ear to be moved away from the longitudinal axis when the bolt is moved towards the locked forward position.

2. The deadlock assembly of claim 1 wherein the casing further includes a pair of side plates between which the bolt is mounted, and the cam follower means includes a pair of rollers mounted on the side plates.

3. The deadlock assembly of claim 1 wherein the casing is of cylindrical configuration along a portion thereof terminating short of the inner wall portion, and the cam follower means includes the internal bore of the cylindrical portion and a conical portion disposed between the cylindrical portion and the inner wall portion, with the conical portion diverging outwardly towards the inner wall portion.

4. A closure assembly as claimed in claim 1, wherein said means pivotally mounting said lever rearward ends comprise a pair of pins each mounted across one of said levers, each pin being located on one side of said longitudinal axis and said levers extending side by side.

5. A deadlock assembly as claimed in claim 1, wherein said means pivotally mounting said lever rearward ends comprise a single pin mounted across both said levers, said pin having a pivot axis intersecting said longitudinal axis, said levers fully overlapping one another in retracted position of said bolt.

6. A deadlock assembly as claimed in claim 1, wherein said plunger has a forward portion provided with a transverse slot and said levers are mounted in said slot in retracted position of said bolt, at least said locking ears projecting out of said slot in extended position of said bolt.

* * * * *